United States Patent [19]

Miura et al.

[11] 4,401,948

[45] Aug. 30, 1983

[54] DIAGNOSTIC APPARATUS FOR INTERNAL COMBUSTION ENGINE IGNITION SYSTEM

[75] Inventors: Kazuhiko Miura, Okazaki; Takakazu Kawabata, Toyota; Tadashi Hattori, Okazaki; Yoshiki Ueno, Aichi, all of Japan

[73] Assignees: Nippon Soken, Inc., Nishio; Toyota Jidosha Kogyo Kabushiki Kaisha, Toyota, both of Japan

[21] Appl. No.: 300,297

[22] Filed: Sep. 8, 1981

[30] Foreign Application Priority Data

Sep. 11, 1980 [JP] Japan ..... 55-126339

[51] Int. Cl.[3] ..... F02P 17/00

[52] U.S. Cl. ..... 324/378; 324/60 C; 324/388; 324/390

[58] Field of Search ..... 324/378, 379, 380, 388, 324/390, 60 C

[56] References Cited

U.S. PATENT DOCUMENTS

| | | | |
|---|---|---|---|
| 3,771,047 | 11/1973 | Spengler et al. | 324/378 |
| 3,921,062 | 11/1975 | Kuhn et al. | 324/378 |
| 3,984,768 | 10/1976 | Staples | 324/378 X |
| 4,112,351 | 9/1978 | Back et al. | 324/380 |

*Primary Examiner*—Stanley T. Krawczewicz

*Attorney, Agent, or Firm*—Cushman, Darby & Cushman

[57] ABSTRACT

A diagnostic apparatus for an internal combustion engine ignition system measures the rise of the secondary voltage at the ignition coil represented by time lapse between initiation of the secondary voltage rising and occurrence of break and the ignition coil primary breaking current value. Results of the measurement are computed to determine stray capacitance existing in the internal combustion engine ignition system and secondary voltage.

5 Claims, 8 Drawing Figures

DIAGNOSTIC APPARATUS FOR INTERNAL COMBUSTION ENGINE IGNITION SYSTEM

BACKGROUND OF THE INVENTION

This invention relates to an apparatus for diagnosing performances of an internal combustion engine ignition system and more particularly to measurement of stray capacitance having great influence on transmission of high voltage and secondary generation voltage representative of spark capability.

In present-day internal combustion engine ignition systems, high voltage generated by ignition coil is transmitted to a spark plug through a high tension cord and a distributor. Since the ignition coil has a relatively high output impedance and the high tension cord runs above an engine body in close proximity thereof, a distributed capacitance called stray capacitance always exists at a secondary distribution portion of the ignition coil. This stray capacitance increases when the high tension cord is deposited with, for example, water or salt water droplets and as a result, high voltage to be applied to spark plug electrodes is decreased as compared with voltage originally generated at the ignition coil. FIG. 1 shows such a state, where abscissa represents a stray capacitance C and ordinate represents a maximum value E of generated voltage, and wherein curves a and b are representative of characteristics for ignition coil primary breaking current values of 5.7 amperes and 3.8 amperes, respectively. While the voltage generated at the ignition coil easily decreases with increase in the stray capacitance in this manner, such an exhaust gas countermeasure as exhaust gas recirculation (EGR) requires a more increased high voltage of the voltage generated at the ignition coil. Accordingly, the probability that the mis-spark occurs becomes high and this imposes a problem on engine performances.

To cope with this problem, it is necessary to develop an ignition coil and a high tension cord which are of high reliability and resistant to voltage reduction. In implementing these countermeasures, an ignition system diagnostic apparatus, especially, a stray capacitance measuring apparatus and a secondary generation voltage measuring apparatus are required.

Incidentally, a commercial electrostatic capacitance meter may possibly be available for measurement of the stray capacitance. However, this meter has great difficulties with the measurement in that the ignition coil is normally separated from the spark plug by the distributor and in that a high voltage is applied. In addition, it is almost impossible to record actual running status with this meter. For measurement of the secondary generation voltage, it is a general practice to measure a maximum value of an open waveform obtained under the condition that the secondary side of the ignition system is isolated from earth to prevent from occurring a break to make discharge. But, during actual running of vehicles, discharge is carried out continuously so that measurement of the secondary generation voltage by this method is impossible.

SUMMARY OF THE INVENTION

To eliminate the above problems, the present invention perceives changes in generation state of the secondary voltage generated at the ignition coil as the stray capacitance increases and contemplates to measure the stray capacitance existing in the ignition system and the secondary generation voltage in process of the break by measuring the changes.

More particularly, as shown in FIG. 2, when the stray capacitance is increased, the ignition coil generation voltage is decreased in its peak value and prolonged in its period. In principle, the stray capacitance can be measured by constantly measuring the peak value Vmax or the period To but a waveform as shown at solid curve in FIG. 2 normally results from discharge occurring at the plug electrodes, thus preventing measurements of Vmax and To. Therefore, it is conceived to obtain formulae which can determine the stray capacitance and secondary generation voltage by using three parameters, namely, time lapse between initiation of rise of the secondary voltage and occurrence of break, breaking voltage, and primary breaking current which determines coil energy, the time lapse and breaking voltage in combination being used to present the gradient of the secondary voltage rising. To this end, one method is such that formulae between the stray capacitance and secondary generation voltage are experimentally derived from the three parameters of the primary breaking current, time for break and breaking current for a specified ignition system. Another method is such that an equivalent circuit is assumed in connection with an ignition system to set up differential equations, the differential equations are solved to obtain an approximate solution of the secondary voltage, an arithmetic equation for the stray capacitance is established, the stray capacitance is determined from the arithmetic equation, and the determined stray capacitance is put into the approximate solution to determine the secondary generation voltage. In the following description, the latter method is given wherein an equivalent circuit is assumed and theoretically analyzed to derive formulae.

With reference to FIG. 3, there is shown an example of an equivalent circuit on the assumption that an ignition system of a transistor contact type is employed. In FIG. 3, E represents a battery voltage, $R_1$ the sum of an external resistance and a coil primary resistance, $L_1$ a coil primary inductance, $T_r$ a power transistor at an ignitor last stage, $R_2$ a coil secondary resistance, $L_2$ a coil secondary inductance, $C_2$ the sum of a coil secondary capacitance and a stray capacitance, M a coil mutual inductance, $i_1$ a primary current, $i_2$ a secondary current, $V_1$ a primary voltage, and $V_2$ a secondary voltage. From FIG. 3, differential equations are established as follows $$R_1 i_1 + L_1 \frac{di_1}{dt} + M \frac{di_2}{dt} + V_1 = E$$

$$R_2 i_2 + L_2 \frac{di_2}{dt} + M \frac{di_1}{dt} + V_2 = O$$

$$V_2 = \frac{1}{C_2} \int i_2 dt$$

Assuming now that the power transistor Tr at the last stage of ignitor requires several of tens of microseconds for turning off the primary current and has a turn-off time $T_s$, and that the primary current $i_1$ is represented by $$i_1 = \frac{I_{off}}{2}\left(1 + \cos\frac{\pi t}{T_s}\right)$$

for $O<t<T_s$ and by $i_1=O$ for $T_s<t$. (Linear assumption may also be made such that $$i_1 = I_{off} \cdot \frac{T_s - t}{T_s}$$

for $O<t<T_s$ and $i_1=O$ for $T_s<t$), the differential equations are then approximately solved as follows: for $O<t<T_s$, $$V_2 = \frac{I_{off}}{2} \cdot k \cdot \sqrt{\frac{L_1}{C_2}} \left\{ \frac{T_s}{\pi} \sqrt{\frac{1}{L_2C_2}} \sin \frac{\pi t}{T_s} - \sin \frac{t}{\sqrt{L_2C_2}} \right\}$$

and for $T_s<t$, $$V_2 = \frac{I_{off}}{2} \cdot k \cdot \sqrt{\frac{L_1}{C_2}} \left\{ \sin \frac{t}{\sqrt{L_2C_2}} + \sin \frac{t - T_s}{\sqrt{L_2C_2}} \right\}$$

where k is a coil coupling coefficient which is represented by $$k^2 = \frac{M^2}{L_1L_2}.$$

FIG. 5 shows comparison between an experimental value and a computed value of the secondary voltage $V_2$. Both the values are fully coincident within a region between initiation of the secondary voltage at which break occurs and a maximum value of the secondary voltage. Letting coil secondary capacitance, stray capacitance, secondary generation voltage, time for break, and breaking voltage be denoted by $C_{L2}$, $C^*$, $V_G$, T and $V_B$, respectively, the stray capacitance $C^*$ and secondary generation voltage $V_G$ are then expressed as follows:

$$C^* = \frac{T^2 - TT_s + T_s^2}{3L_2} \div \left\{ 1 - \sqrt{1 - \frac{4V_B(T^2 - TT_s + T_s^2)}{3I_{off}k\sqrt{L_1L_2}\,(2T - T_s)}} - C_{L2}, \right.$$

$$- C_{L2},$$

$$V_G = \frac{I_{off} \cdot k}{\sqrt{2}} \sqrt{\frac{L_1}{C_2}} \sqrt{1 + \cos \frac{T_s}{\sqrt{L_2C_2}}}.$$

If $V_B$ is corrected in consideration of energy loss due to discharge at the distributor, accuracies of the above equations can than be improved. The stray capacitance and secondary generation voltage are measured by using these equations.

It is in object of this invention to provide an ignition system diagnostic apparatus capable of diagnosing capability of the ignition system during running by measuring the stray capacitance leading to a major cause for secondary generation voltage reduction and the secondary generation voltage based on the method described above.

According to the present invention, the stray capacitance of the ignition system is measured by measuring the gradient of rise of the secondary voltage, and the secondary generation voltage is measured by using the gradient measurement result. This makes it possible to diagnose what influence the changes in environmental condition due to quality of the ignition system layout including the ignition coil, distributor, high tension cord, and ignition plug, humidity, water and salt water have on the generation voltage at the ignition coil. Further, due to simplicity of construction, the apparatus of the invention can be carried on actual vehicles and therefore can advantageously diagnose status of the ignition system during running.

DESCRIPTION OF PREFERRED EMBODIMENTS

Figure 6:
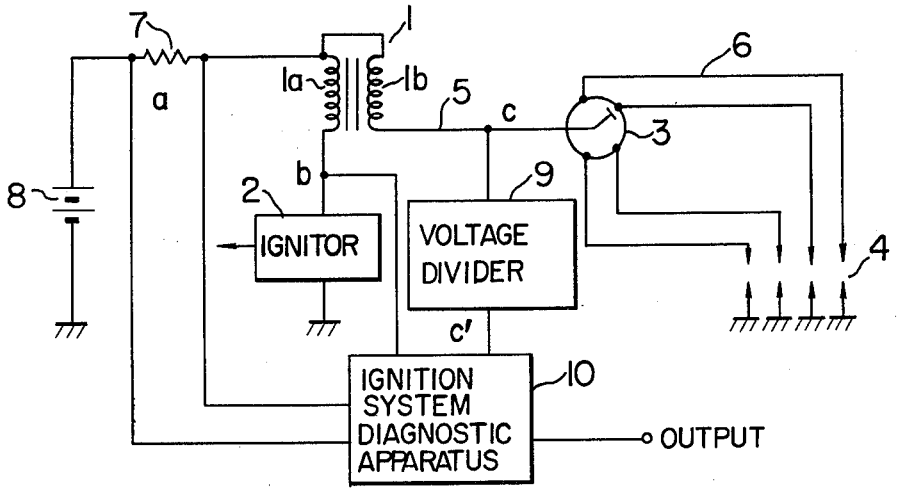
FIG. 6 is a block diagram showing an entire construction of an ignition system according to the invention.

The invention will now be described by way of example with reference to the accompanying drawings. As schematically shown in FIG. 6, an ignition system of the invention comprises an ignition coil 1 having a primary coil 1*a* whose conduction and nonconduction are controlled by an ignitor 2. There are provided a distributor 3 and spark plugs 4, whereby high voltage generated at a secondary coil 1*b* is applied to the spark plug 4 through high tension cords 5 and 6 and the distributor 3. Stray capacitance is meant herein by capacitive components existing in a transmission system of the high voltage. Reference numeral 7 designates an external resistor connected in series with the primary coil 1*a* of the ignition coil 1, 8 a battery, 9 a voltage divider for division and detection of the secondary high voltage of the ignition coil 1, and 10 an ignition system diagnostic apparatus according to the invention.

Figure 7:
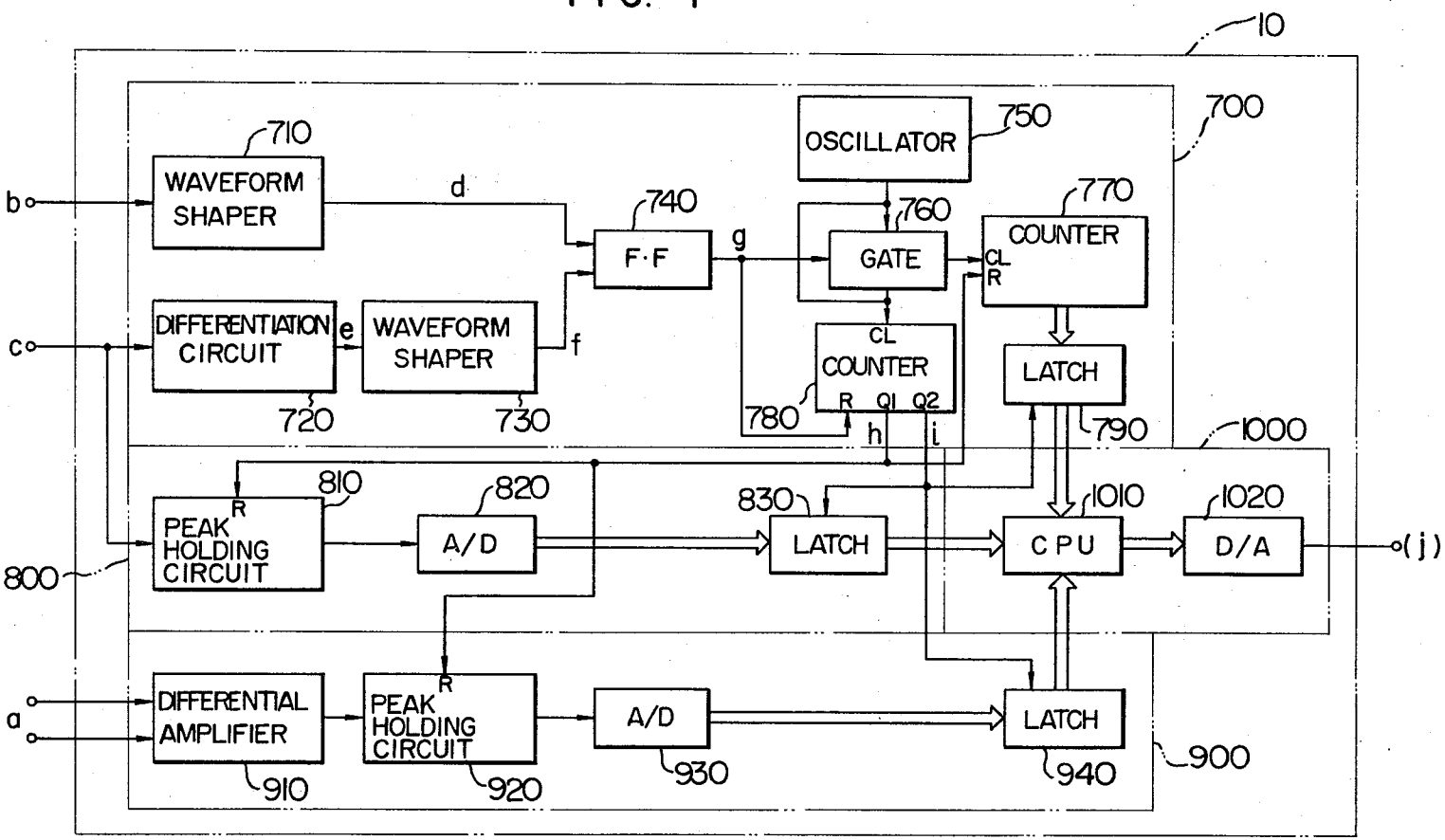
FIG. 7 is a block diagram detailing in part the construction of the system according to the invention.

Next, a first embodiment of the ignition system diagnostic apparatus 10 will be described in greater detail with reference to FIGS. 7 and 8.

Figure 8:
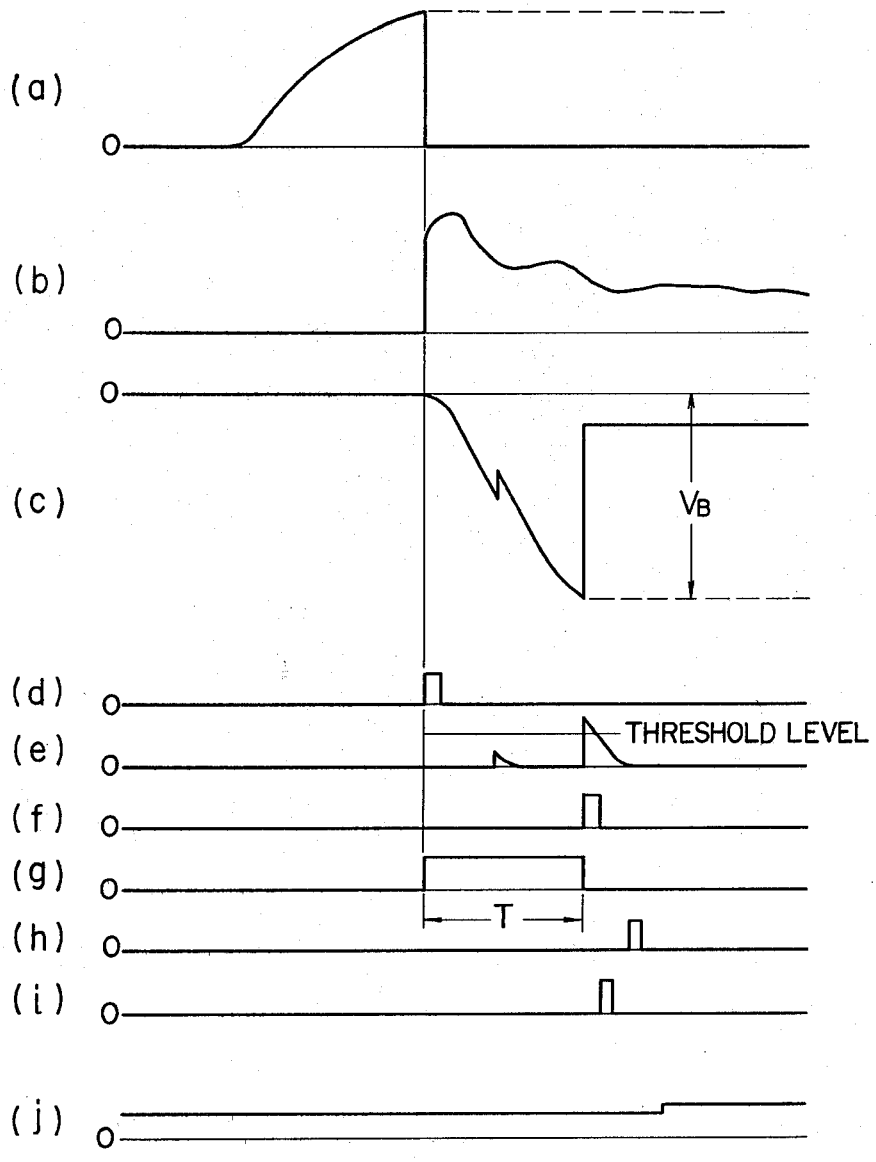
FIG. 8 is a diagram showing waveforms useful to explain the operation of the apparatus shown in FIG. 7.

The apparatus 10 comprises a time measuring circuit 700 adapted to measure time lapse between the rising and break. A waveform shaping circuit 710 in the circuit 700 has an input terminal b connected to a point b in FIG. 6 and applied with a waveform as shown at (b)

in FIG. 8. The waveform shaping circuit 710 converts the FIG. 8 (b) waveform into a pulse as shown at (d) in FIG. 8. A differentiation circuit 720 connected to a point c in FIG. 6 produces a waveform (e) from a waveform (c) in FIG. 8. A waveform shaping circuit 730 operable with a suitable threshold level will not detect discharge at the distributor but will detect only discharge at the spark plug to thereby produce a waveform as shown at (f) in FIG. 8. A flip-flop circuit 740 produces from waveforms (d) and (f) in FIG. 8 a waveform (g) which is representative of time T for break. A gate 760 passes, within an output pulse width of the flip-flop circuit 740, clock pulses from an oscillator 750 to a counter 770 which in turn counts the time T. A counter 780 delivers time difference pulses (pulses (i) and (h) in FIG. 8) which cause a latch 790 to take out resulting counts in the counter 770 and thereafter reset the counter 770. More specifically, the resulting count in the counter 770 is temporarily stored in the latch 790 by means of the pulse (i) in FIG. 8, and the pulse (b) in FIG. 8 resets the counter 770. The measured time T, stored in the latch 790 temporarily, is sent to an arithmetic unit 1000.

A breaking voltage measuring circuit 800 includes a peak holding circuit 810 which holds the peak of the secondary voltage waveform (c) in FIG. 8. This peak holding circuit 810 holds the peak as shown at dotted line in (c) in FIG. 8, and the peak value is converted into a digital value at an A/D converter 820. The digital value is taken out at the timing of the latch signal (i) in FIG. 8 and is sent to the arithmetic unit 1000. Blocks 700 and 800 as set forth hereinbefore constitute a secondary voltage rising gradient measuring circuit.

Figure 4:
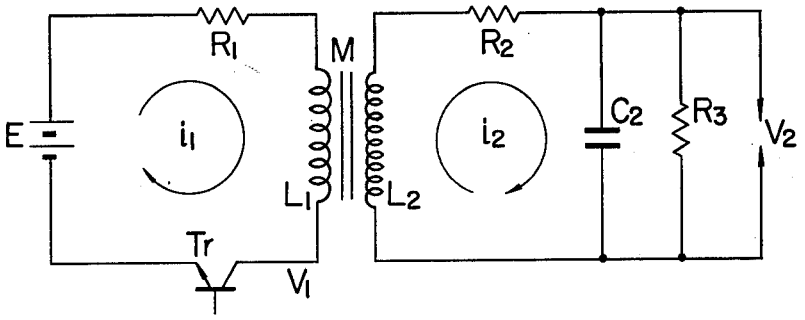
FIG. 4 is a second example of the ignition system equivalent circuit.
Figure 5:
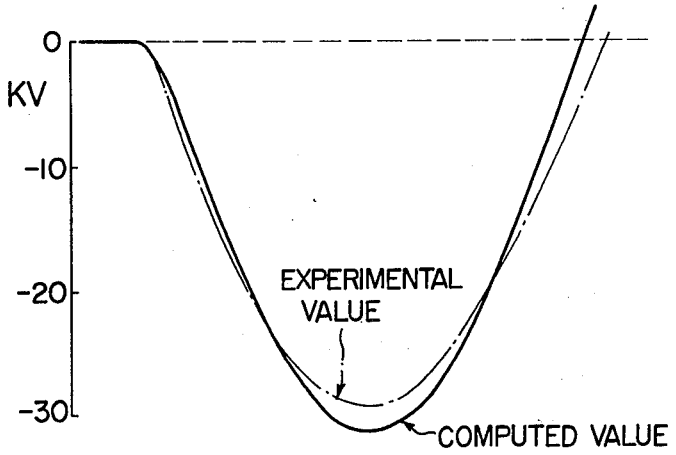
FIG. 5 is a waveform diagram showing the secondary voltage in terms of a computing value obtained from the computing formulae used in the first example and an experimental value.

A primary breaking current measuring circuit 900 includes a differential amplifier 910 which measures a potential difference across the external resistor 7 in FIG. 4 to detect a primary current. A peak holding circuit 920 holds a waveform (a) in FIG. 8 as shown at dotted line and the peak value is converted into a digital value at an A/D converter 930. The digital value is sent to the arithmetic unit 1000 by the aid of the latch 940 at the timing of the pulse (i) in FIG. 8.

The arithmetic unit 1000 comprises a microcomputer arithmetic section (CPU) 1010 and a D/A converter 1020. The CPU 1010 fetches the values of latches 790, 830 and 940, puts them into the formulae for obtaining the stray capacitance and secondary generation voltage, and executes computation for determination of the stray capacitance and secondary generation voltage. The D/A converter 1020 delivers an output as shown at (j) in FIG. 8.

While in the foregoing embodiment the primary breaking current was measured from the voltage across the external resistor connected to the coil, a current sensor utilizing a magnetoresistive element, a Hall element or the like may be used for measurement of the primary breaking current.

Figure 1:
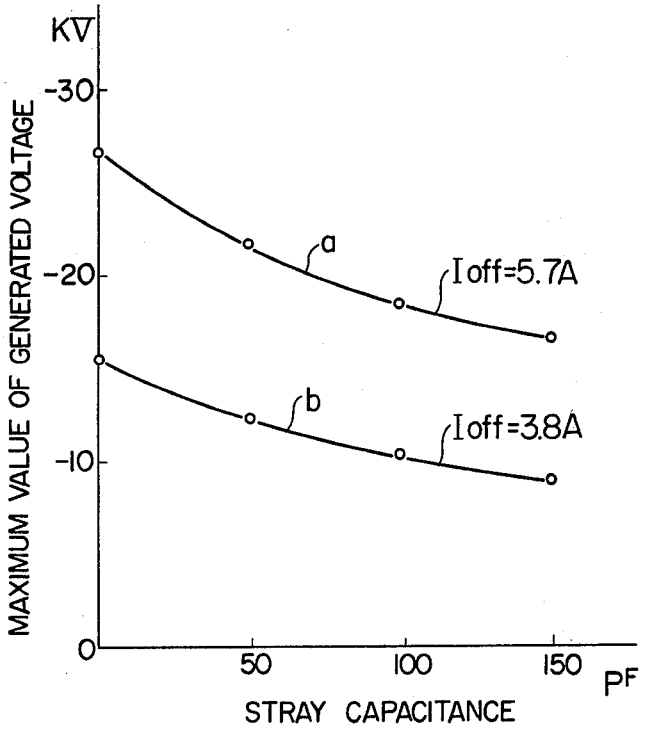
FIG. 1 is a graphic representation useful in explaining the state wherein the maximum value of generation voltage at the ignition coil decreases as the stray capacitance increases.
Figure 2:
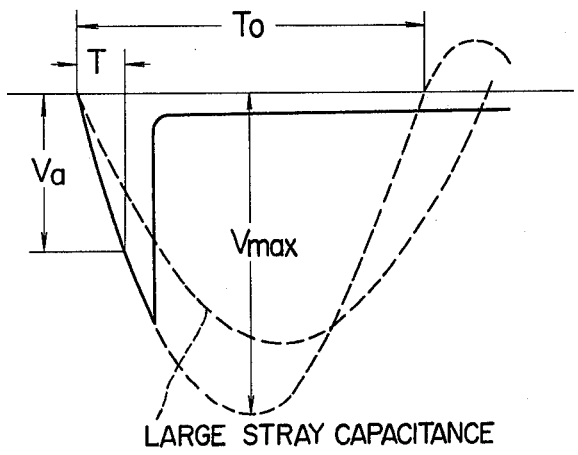
FIG. 2 is a waveform diagram of the ignition coil secondary voltage.
Figure 3:
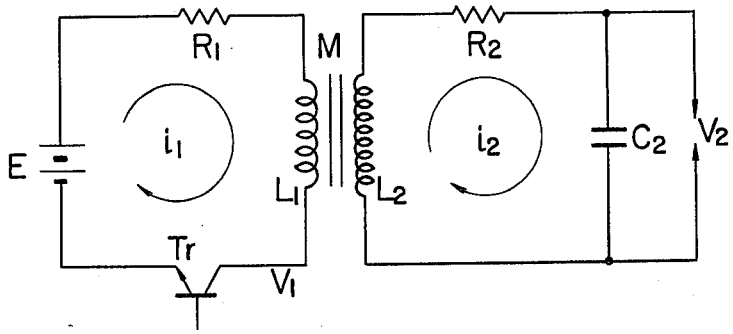
FIG. 3 is a first example of an ignition system equivalent circuit used for deriving computing formulae for determination of the stray capacitance and secondary generation voltage.

The computing formulae used in the first embodiment were derived on the assumption of the FIG. 3 equivalent circuit but an equivalent circuit as shown in FIG. 4 may be assumed wherein a resistor $R_3$ representative of corona loss and the like is added.

Format of the computing formulae of the stray capacitance and secondary generation voltage changes depending on the assumed equivalent circuit, the manner of approximation and the presence or absence of correction, but formulae suitable for performances of the microcomputer such as bit number and speed may be used.

We claim:

1. A diagnostic apparatus for an internal combustion engine ignition system comprising:

a secondary voltage rising gradient measuring circuit for measuring the gradient of rise of a secondary voltage generated by the secondary of an ignition coil;

a primary breaking current measuring circuit for measuring a primary current when the conduction of current through the primary of said ignition coil is interrupted; and an arithmetic circuit for computing the value of stray capacitance existing in the ignition system and the value of secondary generation voltage, from information representative of the gradient measured by said secondary voltage rising gradient measuring circuit and from the value of the primary breaking current measured by said primary breaking current measuring circuit, said arithmetic circuit delivering out the stray capacitance and secondary generation voltage values.

2. A diagnostic apparatus for an internal combustion engine ignition system according to claim 1, wherein said secondary voltage rising gradient measuring circuit receives input signals representative of primary and secondary voltages of said ignition coil to measure time lapse between initiation of the primary voltage rising and occurrence of break and break voltage, and delivers the measured values as information for determination of the gradient of rise of the secondary voltage.

3. A diagnostic apparatus for an internal combustion engine ignition system according to claim 1 or 2 wherein said arithmetic circuit receives digital signals corresponding to the gradient measured by said secondary voltage rising gradient measuring circuit and a digital signal corresponding to the primary breaking current value measured by said primary breaking current measuring circuit to compute the stray capacitance and the maximum value of the secondary voltage in accordance with predetermined predictive computing formulae.

4. A diagnostic apparatus for an internal combustion engine ignition system according to claim 2 wherein said secondary voltage rising gradient measuring circuit comprises a time measuring circuit for measurement of the time lapse between initiation of the secondary voltage rising and occurrence of break, and a breaking voltage measuring circuit, said time measuring circuit including:

a first waveform shaping circuit receiving and shaping a signal representative of the ignition coil primary voltage for generating a pulse signal at the timing of rise of the secondary voltage;

a differentiation circuit receiving and differentiating a signal representative of the ignition coil secondary voltage for generating a pulse signal at the timing of break;

a second waveform shaping circuit for shaping the output of said differentiation circuit;

a flip-flop circuit receiving the outputs of said first and second waveform shaping circuits for generating a pulse representative of the time lapse between initiation of the secondary voltage rising and occurrence of break;

an oscillator for generating clock pulses;

a gate circuit controlled by the output of said flip-flop circuit to gate the output of said oscillator during application of the pulse from said flip-flop circuit; and a counter receiving the clock pulses from said oscillator through said gate circuit for counting the clock pulses, whereby said time measuring circuit digitally records the time lapse between initiation of the secondary voltage rising and occurrence of break into said counter;

said breaking voltage measuring circuit including;

a peak holding circuit receiving a signal regresentative of the ignition coil secondary voltage for holding the peak value of this signal; and an A/D converter for converting an analog signal from said peak holding circuit into a digital signal.

5. A diagnostic apparatus for an internal combustion engine ignition system according to claim 1 wherein said primary breaking current measuring circuit comprises a differential amplifier for amplifying a potential difference across an external resistor connected in series with the primary of said ignition coil, a peak holding circuit for holding the peak value of the output of said differential amplifier, and an A/D converter for converting an analog signal from said peak holding circuit into a digital signal.

* * * * *